US005205139A

United States Patent [19]

Aria

[11] Patent Number: 5,205,139

[45] Date of Patent: Apr. 27, 1993

[54] METHOD AND DEVICE COMPRISING DEFORMABLE SPRING CONTRAINTS FOR NEEDLE SELECTION IN A CIRCULAR KNITTING MACHINE

[75] Inventor: Piero Aria, Florence, Italy

[73] Assignee: Savio S.p.A., Pordenone, Italy

[21] Appl. No.: 810,388

[22] Filed: Dec. 19, 1991

[30] Foreign Application Priority Data

Dec. 21, 1990 [IT] Italy ..... 22472 A/90

[51] Int. Cl.[5] ..... D04B 15/78

[52] U.S. Cl. ..... 66/13; 66/219; 66/221

[58] Field of Search ..... 66/8, 13, 216, 218, 66/219, 220, 221

[56] References Cited

U.S. PATENT DOCUMENTS

| | | | |
|---|---|---|---|
| 3,733,855 | 5/1973 | Bliss-Hill et al. | 66/219 |
| 3,812,691 | 5/1974 | Engelfried | 66/219 |
| 3,863,465 | 2/1975 | De Cerjat et al. | 66/219 |
| 3,974,664 | 8/1976 | Erb | 66/218 |
| 4,196,599 | 4/1980 | Guell | 66/220 X |
| 4,770,009 | 9/1988 | Mozer | 66/218 |
| 4,989,424 | 2/1991 | Furia | 66/219 |

FOREIGN PATENT DOCUMENTS

| | | | |
|---|---|---|---|
| 216358 | 1/1984 | Czechoslovakia . | |
| 0286827 | 10/1988 | European Pat. Off. . | |
| 0343123 | 11/1989 | European Pat. Off. . | |
| 0395383 | 10/1990 | European Pat. Off. | 66/220 |
| 441005 | 8/1991 | European Pat. Off. | 66/221 |
| 2115332 | 3/1971 | Fed. Rep. of Germany | 66/219 |
| 2538418 | 6/1984 | France . | |
| 20548 | of 1913 | United Kingdom | 66/216 |
| 1354980 | 5/1974 | United Kingdom | 66/219 |
| 2043120 | 10/1980 | United Kingdom . | |
| 2058848 | 4/1981 | United Kingdom | 66/220 |

*Primary Examiner*—Clifford D. Crowder
*Assistant Examiner*—John J. Calvert
*Attorney, Agent, or Firm*—George P. Hoare, Jr.

[57] ABSTRACT

A device for needle selection in a circular knitting machine consisting of springs lying below the elastic jacks and rotating with them, to be deformed axially and be retained in their deformed position or to be released therefrom by electromagnetic selectors, in order, respectively, not to retain the elastic jack and thus allow it to rise and activate its respective needle, or to retain the elastic jack flexed within its trick and thus not allow it to activate its needle.

11 Claims, 5 Drawing Sheets

METHOD AND DEVICE COMPRISING DEFORMABLE SPRING CONTRAINTS FOR NEEDLE SELECTION IN A CIRCULAR KNITTING MACHINE

BACKGROUND OF THE INVENTION

1. Field of the Invention

This invention relates to circular knitting machines and in particular to the selection of needles in such machines for the purpose of producing patterned knitwork, and provides a device and method for selecting those needles which are to seize the yarn from the various feed stations to form knitwear.

2. Description of the Related Art

Circular knitting machines consist generally of one or two needle cylinders 1 which, as shown in FIG. 1, comprise tricks 2 in their outer cylindrical surface.

The tricks 2 represent the guide for the needles which during their vertical travel form the stitch loops in co-operation with the sinkers.

The number of tricks is equal to the number of needles which slide in them with reciprocating movement by the effect of raising and lowering cams not shown in the figure.

Generally, in hosiery machines the number of tricks and needles is between 200 and 400.

The cylinder is rotated and with it there rotate the needles which during their reciprocating movement are fed with yarn in fixed angular positions when in their highest point of travel by feed stations consisting of one or more yarn guides which are selectively presented to the needle hooks so that they seize from them the yarn with which they have to produce that determined portion of knitwork.

To produce hosiery articles or other types of knitted hose, generally only a fraction of the available needles are used at the same time and in the same manner, except for the plain knitwork parts of the hose, for which all the needles are operated between their maximum and minimum level, all being fed with yarn at each knitting course, and all being moved in the same manner.

When the machine is not producing plain knitwork, in order to produce other types of knitwork some needles are required to produce stitch loops and therefore be raised to the maximum level at the feed station in order to seize the yarn, while others have to be raised to an intermediate level to take up yarn without clearing the previous stitch in order to form a tuck stitch, or have to be raised with a certain delay so that they do not seize the yarn fed in that feed station and therefore do not form new loops with it. In other words a needle selection has to be made. This means that before each feed it has to be determined which and how many needles must undergo a certain travel and which and how many other needles must undergo a certain different travel or indeed undergo no travel.

Again with reference to FIG. 1, this selection is effected by the jacks 4 which slide in the same tricks 2 as the needles lying above them, to urge the needles 3 upwards and move them to a higher level in order to seize the yarn. After seizing the yarn the needles are controlled in their reciprocating movement by their own cams and counter-cams which are fixed relative to the cylinder, but are not indicated in the figures.

FIG. 1 shows an elastic jack 4, able to radially flex its lower end.

FIGS. 1 and 2 show a preferred embodiment for the needle cylinder 1, in which the tricks 2 are formed by inserting strip inserts 2' into the cylinder surface, this resulting in guide surfaces of greater accuracy and greater wear resistance. When the jacks 4 have moved their needle into its working position they withdraw from the needle butt and return downwards. If the needle, after completing its task of seizing the yarn and forming the stitch loop and therefore being at its minimum level, is not required to seize a further yarn from another feed it remains at this level because its control jack remains in its lower rest position.

The shank of the jack 4 comprises in its middle part a projection 5, i.e. the upper guide butt, which comes into engagement with its own control cam 6 for urging the jack downwards when it has completed its task of raising the needle 3, as far as an opposing cam 7.

Proceeding downwards along the jack shank there is a lower butt 8 which comes into engagement with the lower cam ring, consisting of a raising cam 9 which raises the jack together with its overlying needle, this therefore being selected to seize the yarn, and a cam 10 which with its inner face engages the vertical face of the butt 8 to urge the foot of the elastic jack 4 into the interior of the trick 2 by flexing it. When in this position of approach to the interior, the butt 8 is unable to engage the contour of the raising cam 9.

The lowering contours 6 and the raising and approach contours 9 and 10 are offset angularly and operate at different times on each jack.

In circular knitting machines, needle selection is generally conducted by maintaining those jacks corresponding to the needles to be raised by the butt 8 in a position displaced outwards to cause it to engage the raising contour 9, while maintaining those jacks corresponding to the needles not to be raised in their position of approach to the interior, whether elastic jacks or conventional rigid jacks are used.

When elastic jacks are used, as in the present invention, they tend spontaneously to move their butt 8 outwards to engage the contour 9 by virtue of their elastic force, whereas with conventional jacks their approach movement is effected by fixed cams arranged about the cylinder.

The elastic jacks are maintained in position so that the flexure of their lower part does not cause their upper part to escape from the trick, this being achieved for example by one or more rigid circular rings 11 fixed to the cylinder and surrounding their upper part. The purpose of these springs is to oppose the forces which flex the shank of the jack so that the forces acting on the butt 8 induce said flexure, rather than causing the upper part of the jacks to leave the tricks. A further rigid ring 12 limits the elastic return travel of the foot of the jack 4 to the distance sufficient for it to be able to rise on the contour 9 and not beyond.

As already stated, the purpose of the needle selection device and procedure is to exclude from this totality of jacks, by maintaining them in their inward position, the jacks which control those needles which in forming the particular stitch are not required to be raised.

The conventional selection system uses mechanical selectors acting on a series of intermediate butts, but this type of selection has considerable limits in terms both of operation and of the number of possible selections.

The most recent machines use electromagnetic selection devices which allow a greater selection speed and a greater number of programmable selections, with advantages in terms of machine production and the greater variety of possible patterns.

These selection devices are divided essentially into two categories, namely fixed devices which do not rotate with the cylinder and are positioned to precede each feed station, to which the jacks are presented in sequence as they rotate, and selection devices which rotate together with the cylinder (and with its jacks) and which are therefore always each in a position corresponding with its own jack and can thus act on the jacks at any moment, rather than only during the very short time in which the jack passes in front of them.

This second type of selection must also be effected after the jacks have returned downwards but before they encounter the raising cams 9, but there is greater freedom with regard to the requirements of synchronization and the constraints on the time available for the selection, compared with selectors of the first type.

Selection devices of the first type are described in European Patent No. 0 379 745 in the name of Furia, in European patent application 219029 in the name of Lonati, in GB patent application 2,008,157 in the name of Shima, in GB patent application 2,112,822 in the name of Elitex, in GB patent 1,436,607 in the name of Precision Fukuhara, and in French patent 1,564,603 in the name of Mayer, in which the jack selection is generally achieved—prior to each feed—by deforming or displacing auxiliary members arranged around the needle cylinder by means of fixed cams and then retaining or releasing these members by means of electromagnetic actuators.

Selection devices of the second type are described in European patent application Public. No. 0 379 234 in the name of Gargiani and No. 0 441 005 in the name of SAVIO.

The present invention relates to a device and method of the first aforesaid type for needle selection in a circular knitting machine and is described hereinafter with reference to FIGS. 1 to 5, which show typical embodiments thereof by way of non-limiting example.

SUMMARY OF THE INVENTION

The present invention generally relates to an electromagnetic device for selecting needles in a circular knitting machine having a needle cylinder. The device comprises a jack for activating a corresponding needle, wherein the jack is slidably housed in a groove of the cylinder and is biased toward an active position. The device also comprises a cam for radially moving the jack from the active position to an inactive position and a spring corresponding to the jack and positioned below the jack and substantially within the circumference of the needle cylinder. The spring is biased for engaging the jack in the inactive position. The spring is axially deformable for releasing the jack from the engagement thereby allowing the jack to return to its active position. The device further comprises a stationary selection electromagnetic device located proximate the spring. The selection device has a permanent magnet for attracting the spring and an electromagnet. The electromagnet is selectively de-energized or is energized for creating a concurrent force with the permanent magnet for selectively attracting the spring out of engagement with the jack when the jack is to be placed in the active position and the electromagnet is selectively energized for creating a counter force to the permanent magnet for selectively repelling the spring thereby allowing the spring to engage the jack when the jack is to be placed in the inactive position.

Figure 1A:
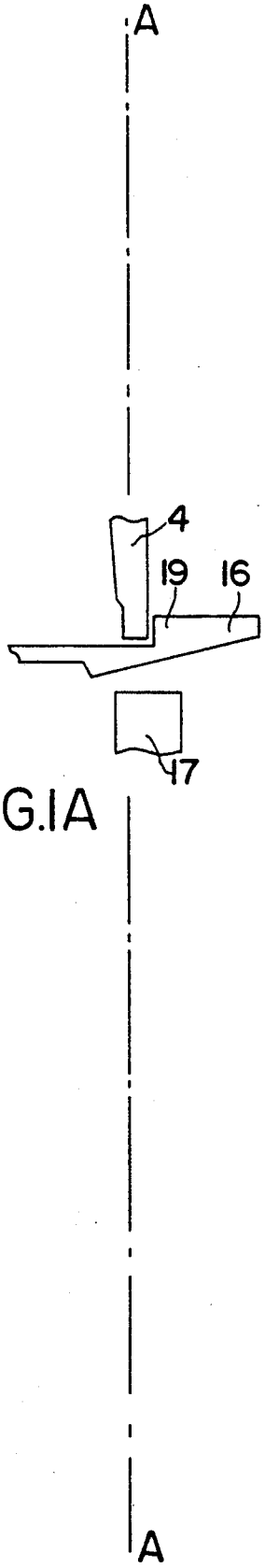
FIG. 1A is an enlarged view of the tooth of the spring shown engaging the jack as shown in FIG. 1.
Figure 1:
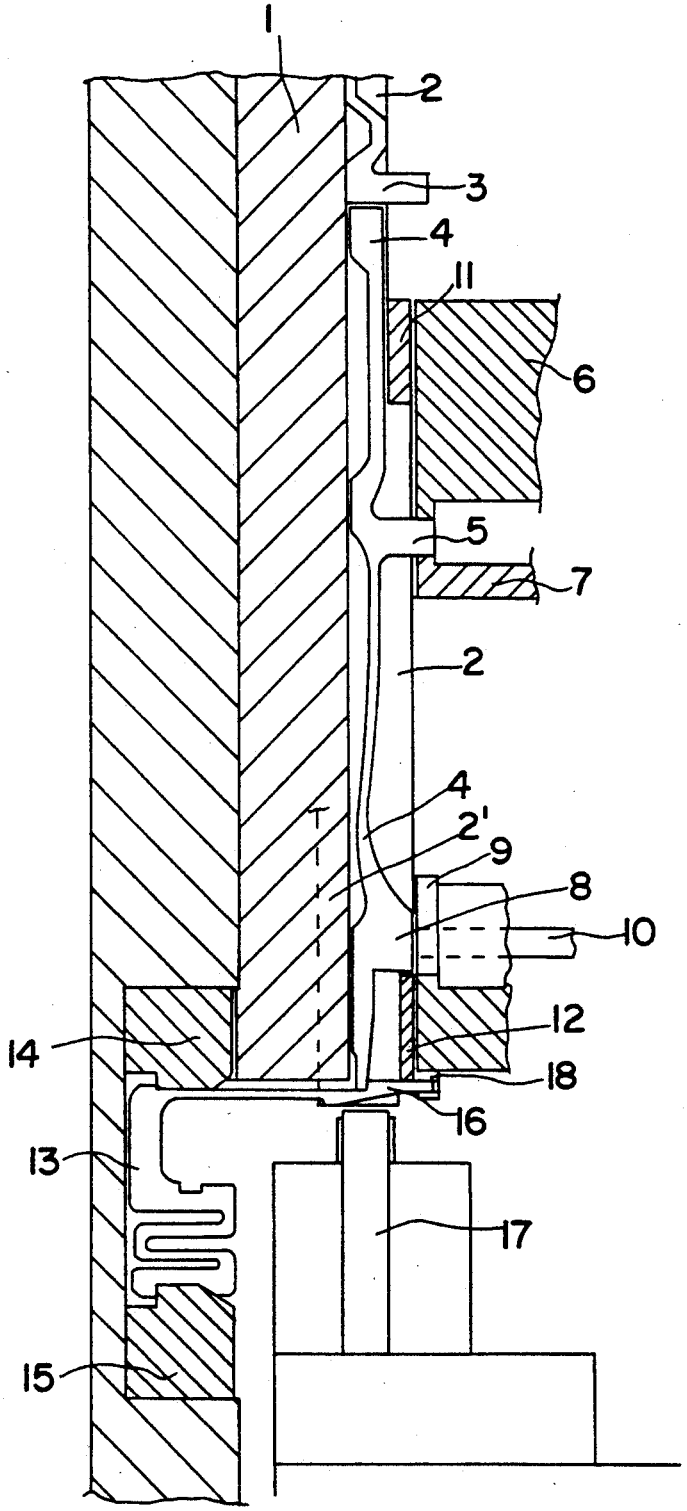
FIG. 1 is a radial section through the needle cylinder with the jack shown not engaging the raising cam.
Figure 2A:
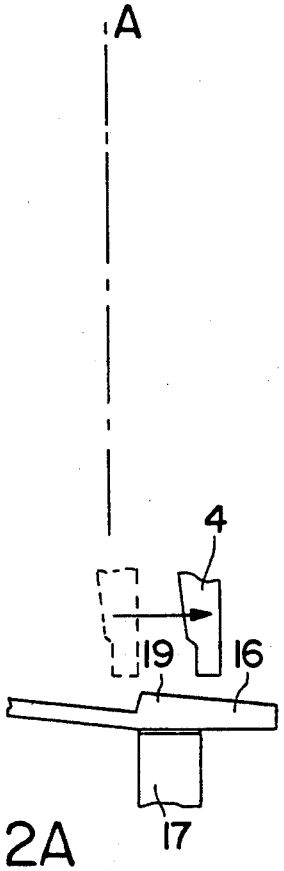
FIG. 2A is an enlarged view of the tooth of the spring shown with the jack disengaged as shown in FIG. 2.
Figure 2:
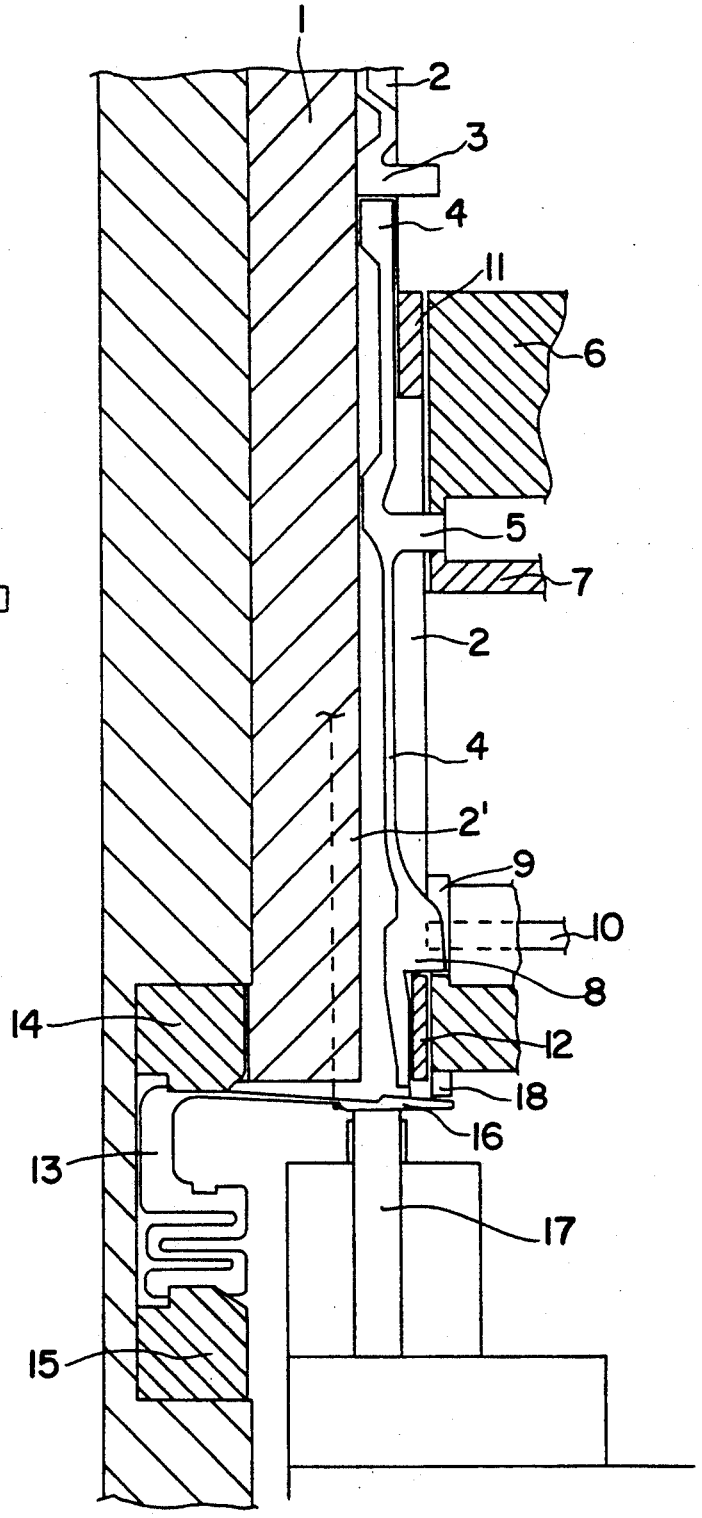
FIG. 2 is a radial section through the needle cylinder with the jack shown in its outwardly released position.

The jack 4 is an elastic jack, in that its lower part is more slender than conventional jacks and is flexible in the plane of FIGS. 1 and 2, in which the jack is shown in FIG. 1 in its inwardly flexed configuration in which it does not engage the raising contour 9, and in FIG. 2 in its outwardly released configuration in which it engages the contour 9. With each jack 4 there is associated an underlying spring 13 which lies in the same plane as the jack and as the cylinder axis AA. The springs together with their positioning and fixing members are contained within the cylindrical surface of the tricks and thus lie within the cross-section through the needle cylinder.

The springs are preferably flat, are equal in number to the number of jacks 4 and are in angular phase with them. They are constructed of ferromagnetic material and are housed in radial guides provided in the rings 14 and 15 which retain them in position, whereas their outer end 16 is guided in its axial elastic oscillation by the strip inserts 2' which define the tricks 2.

The rings 14 and 15 are positioned below the needle cylinder and have a smaller diameter than the cylinder.

By virtue of their elasticity, the springs 13 tend to remain with their end 16 raised, unless other forces intervene to flex them downwards.

The two configurations are shown in FIG. 1 and FIG. 2 respectively.

The flexure of the end 16 is achieved, before encountering the electromagnetic selection member 17, by a flexing cam 18 which flexes all the ends 16 to urge them into proximity or into sliding contact with the selector 17 which, depending on its energization at any given moment, either retains the end 16 flexed on being presented with it, or allows it to return upwards.

According to a preferred embodiment of the present invention, the electromagnetic selection device 17 is positioned within the base of the needle cylinder, in a highly compact arrangement which enables the overall size of the selection device to be reduced. An electromagnetic selection device 17 particularly suitable for needle selection consists in its essential elements of a part energized by a permanent magnet which permanently attracts the ends 16 flexed by the action of the cam contour 18 so that they make contact with it, and an interposed part energized by an electromagnet which is either not energized or is energized in opposition to or in accordance with the action of the permanent magnet, so as to release the ends 16 of the springs 13 loaded elastically by the cam 18, or to retain them flexed downwards. A selection device of this type for a single selection position is significantly illustrated in the Czechoslovakian certificate of authorship No. 216358.

An electromagnetic selection device with a plurality of positions forms the subject of U.S. patent application Ser. No. 07/797,127.

The present invention is described hereinafter with reference to this electromagnetic selection device comprising several selection positions, it being noted however that the present invention can also be implemented with electromagnetic selectors of different type, with one or more selection positions.

Figure 3A:
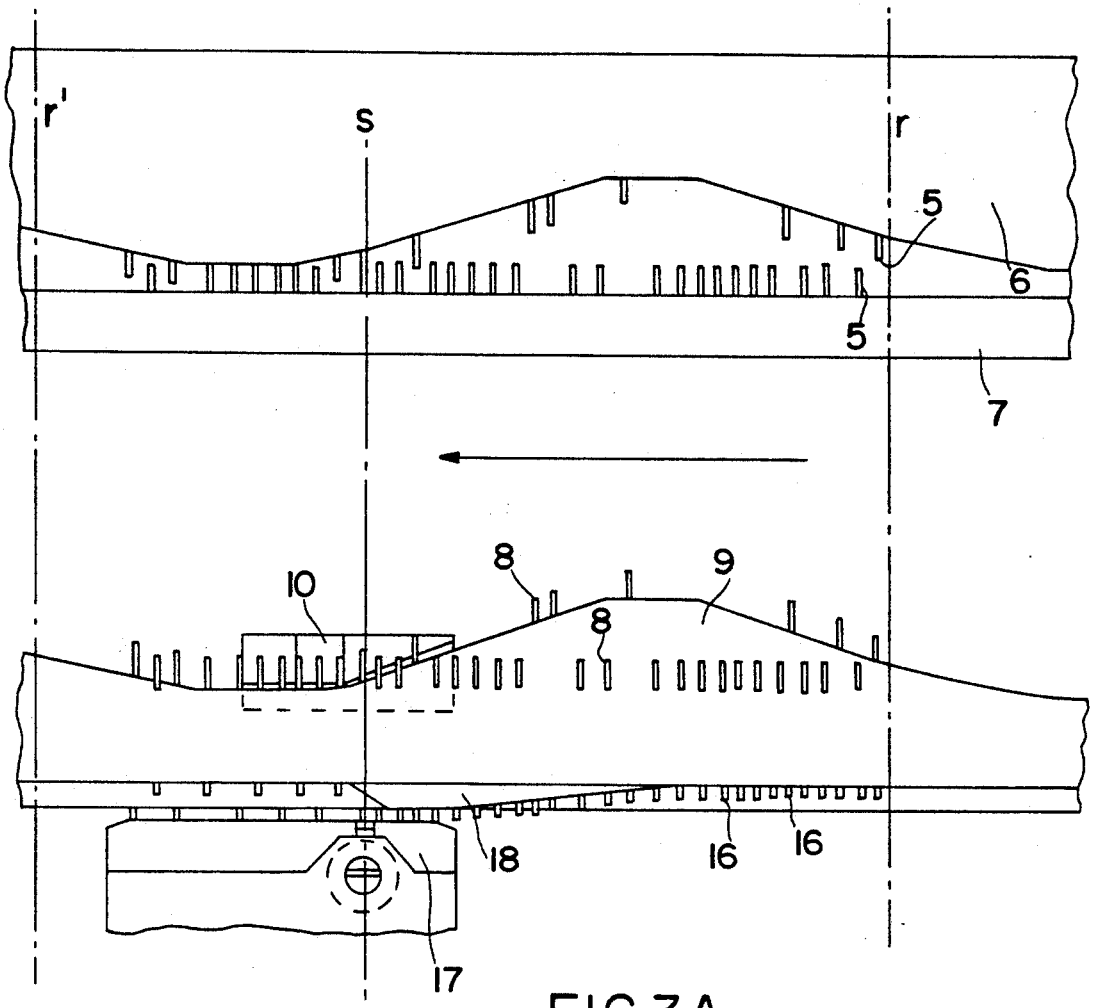
FIG. 3A is a developed view of the cam skirt showing the paths of the butts (5 and 8).
Figure 3B:
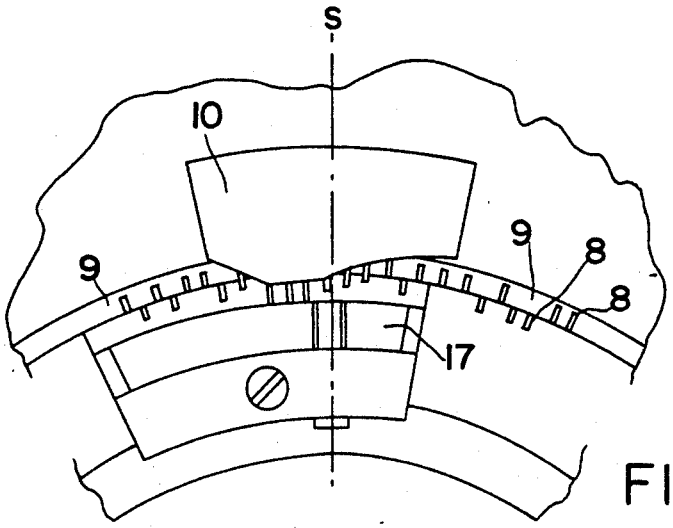
FIG. 3B is a plan view showing the paths of the butts and the electromagnetic selector.

In FIG. 3A, which represents a lateral cylindrical development, the upper part shows the paths of the two butts 5 and 8 of the jack 4 in moving from right to left, and the lower part shows the paths of the ends 16 of the springs 13, together with the effect of the cams which drive these members. FIG. 3B is a plan view showing the paths of the jack butts and the electromagnetic selector 17.

Starting from the reference line r, all the springs 13 are in the released state and their ends 16 are all in the high position. The jacks 4 have been selected by the previous selector, in that those with the butt 8 in the outward position rise with said butt on the cam 9 and urge the corresponding needles upwards into activation, while those with their butt 8 in the inward position pass behind the cam 9 and remain low, with their upper butt 7 resting on the cam 7. The corresponding needle remains inactivated.

After activating their needle, the jacks 4 which have risen on the cam 9 return downwards by the effect of the cam 6. At the end of the lowering contour of the cam 6 all the jacks are in their lowered position and all the springs 13 are elastically loaded by the effect of the cam 18 which lowers their end 16, and are thus presented to the electromagnetic selector. By the effect of the cam 10 the jacks lowered by the cam 6 are also flexed into the tricks 2 by the contour of the approach cam 10.

If, as in FIG. 1, the electromagnetic selector 17 does not retain the end 16 of the loaded spring, said end returns upwards and by means of its tooth 19, which is shown enlarged, in FIG. 1A engages the foot of the jack and an retains it flexed inside the trick. If instead, as in FIG. 2, the electromagnetic selector 17 retains the loaded spring, said end 16 remains low and its tooth 19 cannot interfere with the foot of the jack 4, as shown in detail inn FIG. 2B and can thus pass from the inward position shown by dashed lines to the outward position shown by full lines in the enlarged view, as soon as the action of the approach cam 10 ceases.

Figure 4B:
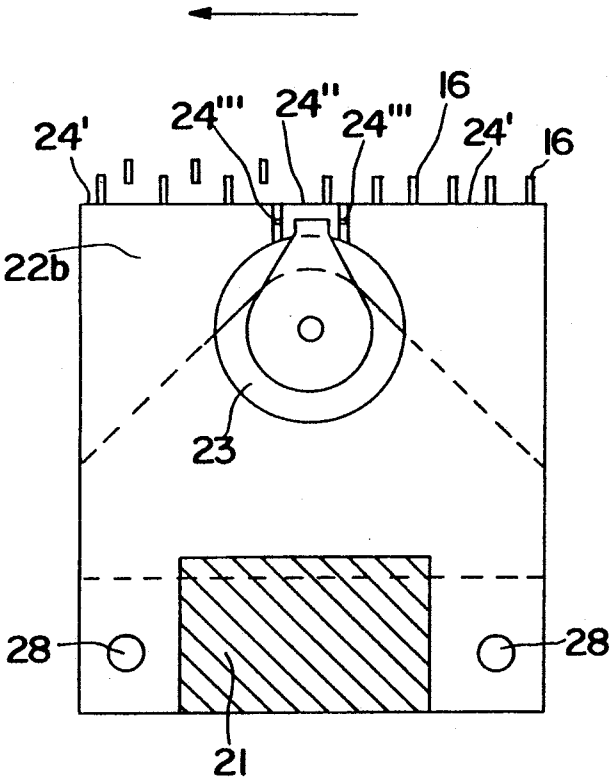
FIG. 4B shows a sectional view of the selection device according to the present invention along the axis lines B—B of FIG. 4A.
Figure 4A:
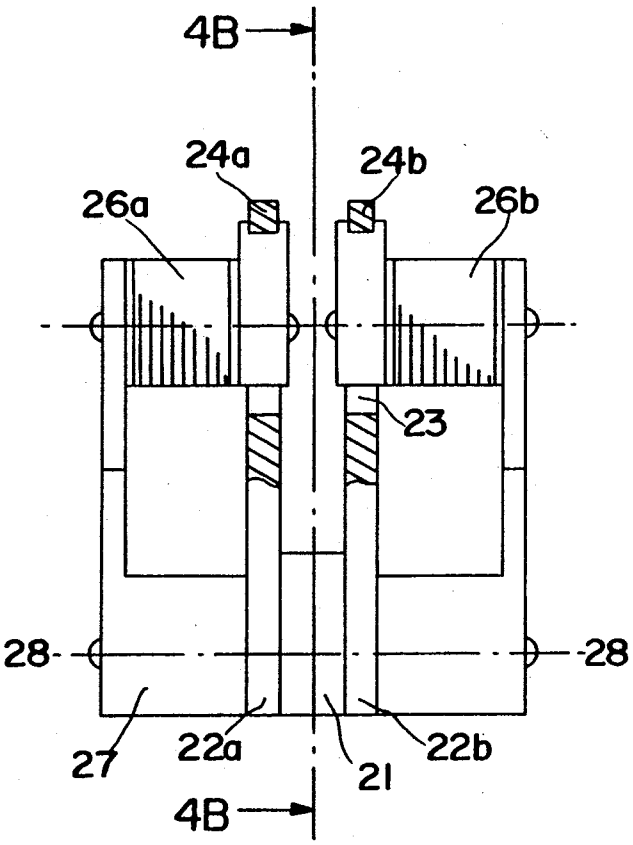
FIG. 4A shows a side view of the selection device according to the present invention.

A preferred embodiment particularly suitable for using double position electromagnetic selectors is shown in FIGS. 4A, 4B, 5A and 5B. FIGS. 4A and 4B show the construction of a typical two-position selector by way of non-limiting example.

In the construction shown in FIGS. 4A and 4B, the selection device uses a single permanent magnet 21 of North and South polarity at its two opposing bases. Two parallel plates **22*a* and 22*b* of ferromagnetic material are connected to these North and South bases, each of the plates being provided with a cavity 23** for housing the electromagnetic part of the device.

The two upper edges **24*a* and 24*b* of the device are traversed by the ends 16 of the flexed springs to undergo selection. The edge 24*a* selects the springs carrying the index "a" and the edges 24*b*** selects the springs carrying the index "b".

Each edge **24*a* and 24*b* consist of two end parts 24' pertaining to the plate 22 and having a constant magnetic polarity (North or South) as induced in them by the permanent magnet 21, and a central part 24" which forms the pole piece of the electromagnet 26 and assumes a magnetic polarity depending on the direction of the electric current through its winding. As stated, the ends 16 slide along the edge 24 loaded by an elastic force which tends to cause them to separate from this edge. If the electromagnet 26 is energized such as to oppose the attraction by the pole pieces of the permanent magnet, the ends 16 sliding along the edge 24 within the region 24" are no longer attracted and separate from said edge by the effect of their elastic force. They then follow a different trajectory from those springs which continue to encounter magnetic attraction within the region 24" because the electromagnet is not energized in opposition to the permanent magnets, i.e. it is either energized in the same direction as the permanent magnets to thus increase their attraction, or is not energized at all and thus allows the pole piece 24" to assume the polarity of the adjacent parts 24'**.

The jacks selected in this manner by their springs enter into engagement with various members located along their trajectory, and operate differently from those of FIG. 3A.

The parts 24' and 24" are separated magnetically by inserts 24''' of diamagnetic material.

The electromagnets **26*a* and 26*b* are supported by the supports 27 and are locked together by the bolts 28**, by which the device is assembled.

The edges **24*a* and 24*b* can be equal and have their various parts 24', 24" and 24'''** of equal angular dimensions and positioned with the same gaps between, or they can be different and/or positioned with different angular gaps.

In other words the device can be either symmetrical in its two parts or be asymmetrical.

The electromagnetic devices 26 can be energized to create a magnetic field opposing that of the permanent magnet 21, so as to strongly reduce the total magnetic attraction on the flexed springs during their passage in front of 24". Because of their elastic force they then return with their end 16 distant from 24" and unflexed. Alternatively they can be energized to create a magnetic field concordant with that of the permanent magnet 21 so as to retain the springs 13 in their flexed position and keep their end attracted to the region 24" so that they then continue their path adhering to the second region 24' following 24". If the region 24" is of large angular width it is sufficient not to energize the electromagnet 26 for the elastic force of the springs to prevail. If however they are to be maintained flexed, the electromagnet must be energized concordantly with the permanent magnet 21.

If the region 24" is only of small angular width, the fact of not energizing 26 is not sufficient to release the flexed springs. To release them it is therefore necessary to energize 26 in opposition to 21.

The springs undergo selection by passage in front of the region 24", in that those retained in the flexed position continue along the region 24' adhering thereto, whereas those released within the region 24" proceed separated from the region 24' because the force of attraction decreases strongly as the distance increases, the force of attraction of the region 24' not being sufficient to reattract the released springs which have separated.

Figure 5B:
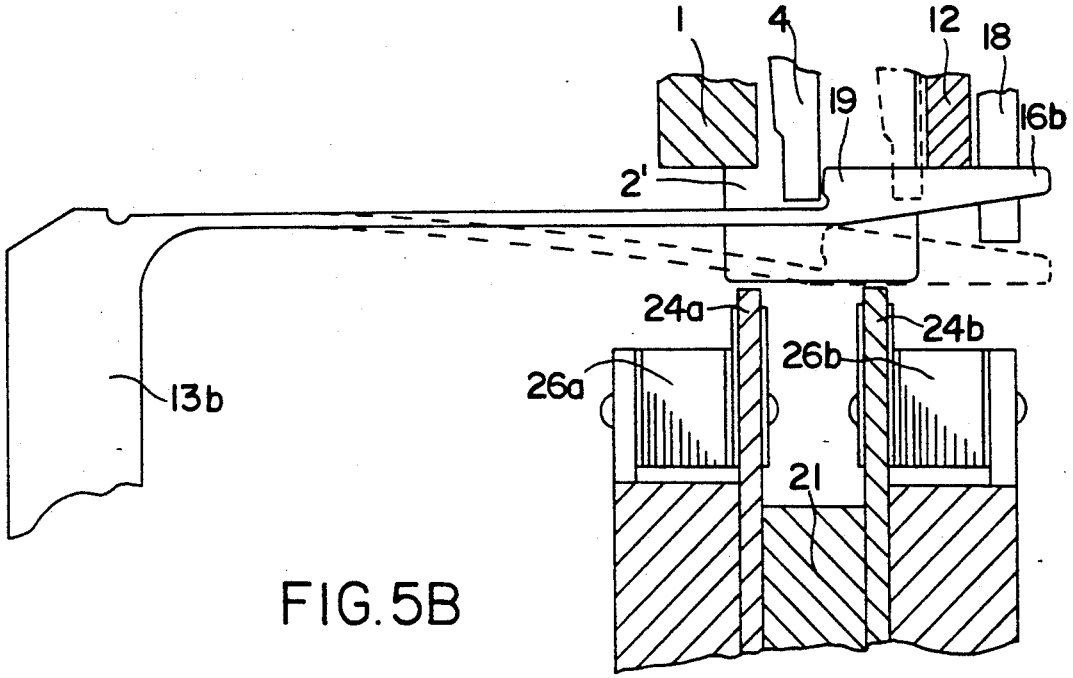
FIG. 5B is a radial section of another configuration of the spring according to the present invention.
Figure 5A:
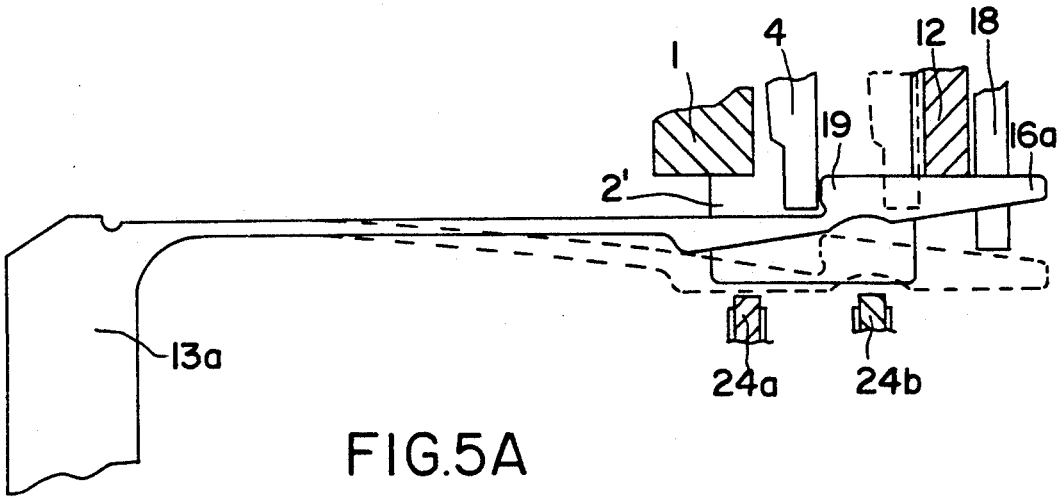
FIG. 5A is a radial section of one configuration of the spring according to the present invention.

To properly utilize the performance of the two-position electromagnetic selector shown in FIG. 4, the springs 13 are constructed in two configurations, 13*a* as shown in FIG. 5*a* and 13*b* as shown in FIG. 5*b*, for selection by the pole piece 24*a* of the inner selector and by the pole piece 24*b* of the outer selector respectively.

The spring of configuration 13*a* has a cavity in a position corresponding with the pole piece 24*b*, so as not to be retained by it, and comprises in its elastic shank a plate which makes contact with the pole piece 24*a*, to be retained by it.

In contrast, the spring of configuration 13*b* does not have the plate of 13*a* in its elastic shank and is therefore spaced from 24*a* even in the flexed position so as not to be retained by it, whereas the terminal part of the end 16 makes contact with 24*b* when flexed by the cam 18.

The springs of the two configurations alternate along the circumference of the needle cylinder.

The angular width of the regions 24" corresponds to about two steps of the cylinder.

As already described, on reaching the reference line s all the jacks have been lowered and flexed into the tricks 2 and all the springs are elastically loaded.

The springs 13*a* pass adhering to the edge 24*a* and the springs 13*b* pass adhering to the edge 24*b*, to reach the pole pieces 24"*a* and 24"*b* of the electromagnets 26*a* and 26*b* in their flexed configuration.

Depending on the state of energization of said electromagnets, either the ends 16*a* and 16*b* of the springs 13*a* and 13*b* are retained adhering to the pole pieces 24*a/b* in the dashed-line position to allow the jack 4 to then return to its working position illustrated by dashed line at the end of the cam 10, or the ends 16 are released and return upwards so that the tooth 19 prevents the jack 4 returning outwards, and thus retaining it in its inward non-working position shown by full lines. The selection device of the present invention results in considerable constructional advantages and advantages in the production process for knitted hosiery.

These advantages include the smaller number of cams required for needle selection and the smaller overall size of the needle cylinder and of the members involved in needle selection.

The use of the spring 13 instead of equivalent auxiliary selection elements, horizontal or vertical auxiliary jacks, reciprocating slides, rocker arms etc. of the known art results in a considerable saving both in the weight of the rotating masses and in the machine construction and maintenance costs.

It should be noted that the selection movement undergone by the springs 13 is only in the axial direction and is not influenced by centrifugal force, therefore being substantially indifferent to the rotational speed of the machine.

Needle selection can take place even at a speed exceeding 1000 r.p.m. without any uncertainty in terms of correct positioning and operation of any part of the selector complex.

I claim:

1. An electromagnetic device for selecting needles in a circular knitting machine having a needle cylinder, comprising:

a) a jack for activating a corresponding needle, wherein said jack is slidably housed in a groove of the cylinder and is biased toward an active position;

b) a cam for radially moving said jack from said active position to an inactive position;

c) a spring corresponding to said jack, and positioned below said jack and substantially within the circumference of the needle cylinder, wherein said spring is biased for engaging said jack in said inactive position, and wherein said spring is axially deformable for releasing said jack from said engagement thereby allowing said jack to return to its active position; and d) a stationary selection electromagnetic device located proximate said spring, wherein said selection device has a permanent magnet for attracting said spring and an electromagnet, wherein said electromagnet is selectively de-energized or is selectively energized for creating a concurrent force with said permanent magnet for selectively attracting said spring out of engagement with said jack when said jack is to be placed in said active position and said electromagnet is selectively energized for creating a counter force to said permanent magnet for selectively repelling said spring thereby allowing said spring to engage said jack when said jack is to be placed in said inactive position.

2. The device of claim 1, further comprising a first and a second retaining ring having radial guides therein for housing said spring, wherein said retaining rings have a diameter less than the needle cylinder.

3. The device of claim 1, further comprising a flexing cam located proximate said selection electromagnet for flexing said spring toward said selection electromagnet.

4. The device of claim 1, wherein said selection electromagnet is disposed within the needle cylinder base.

5. The device of claim 1, wherein said selection electromagnet comprises a ferromagnetic plate having two members and a permanent magnet connected thereto and including an electromagnetic interposed between said members, and further including diamagnetic material interposed between said electromagnet and said members.

6. The device of claim 5, wherein each of said members is connected to opposite poles of said permanent magnet so that one of said members has a north polarity and the other of said members has a south polarity and wherein each of said members is operatively associated with a selection electromagnet.

7. The device of claim 6, comprising a plurality of springs associated with a corresponding plurality of jacks, wherein adjacent springs are configured differently, one from the other.

8. The device of claim 7, wherein said selection electromagnets for selecting adjacent springs are located at different radial distances from the device for operatively associating with said different configurations of said adjacent springs.

9. The device of claim 8, wherein the selection electromagnet is energized for creating a magnetic field opposing the magnetic field of said permanent magnet for releasing one of said springs attracted by said permanent magnet.

10. The device of claim 8, wherein the selection electromagnet is energized for creating a magnetic field in accordance with the magnetic field of said permanent magnet for retaining one of said springs attracted by said permanent magnet.

11. The device of claim 8, wherein said spring further comprises a tooth adapted for engaging said jack and keeping said jack in said inactive position while said jack is subjected to said movement of said cam.

* * * * *